US005790917A

United States Patent [19]

Takura et al.

[11] Patent Number: 5,790,917

[45] Date of Patent: Aug. 4, 1998

[54] DEVELOPING DEVICE HAVING A RESIDUAL TONER AMOUNT DISCRIMINATION FEATURE AND IMAGE FORMING APPARATUS USING SAME

[75] Inventors: Keizo Takura, Kashiwa; Tsuyoshi Kunishi, Moriya-machi, both of Japan

[73] Assignee: Canon Kabushiki Kaisha, Tokyo, Japan

[21] Appl. No.: 739,016

[22] Filed: Oct. 28, 1996

[30] Foreign Application Priority Data

Oct. 30, 1995 [JP] Japan ..... 7-303320
Nov. 16, 1995 [JP] Japan ..... 7-298195

[51] Int. Cl.[6] ..... G03G 15/08

[52] U.S. Cl. ..... 399/27; 118/694; 399/61

[58] Field of Search ..... 399/27, 29, 61–65; 118/688, 689, 694; 222/DIG. 2

[56] References Cited

U.S. PATENT DOCUMENTS

| | | | |
|---|---|---|---|
| 4,506,804 | 3/1985 | Oka | 222/DIG. 1 |
| 4,992,831 | 2/1991 | Kunishi | 399/223 |
| 5,287,151 | 2/1994 | Sugiyama | 399/258 |
| 5,587,770 | 12/1996 | Jo et al. | 399/64 X |

*Primary Examiner*—William J. Royer
*Attorney, Agent, or Firm*—Fitzpatrick, Cella, Harper & Scinto

[57] ABSTRACT

A developing device is constructed by a developing unit for developing an electrostatic latent image on an image holding member, a developing agent containing unit for containing a developing agent which is supplied to the developing unit, an agitator, provided in the developing agent containing unit, for agitating the developing agent, a detecting sensor for detecting a residual amount of developing agent in the developing agent containing unit, and a determining device for determining the residual amount of developing agent at a plurality of levels on the basis of an output state of the detecting sensor in a predetermined time range. The determining device determines the residual amount of developing agent on the basis of a ratio of an output time of a developing agent presence state of the detecting sensor and an output time of a developing agent absence state in the predetermined time range. When a ratio at which the output time of the developing agent presence state of the detecting sensor occupies in the predetermined time range is equal to or less than a predetermined value, the determining device determines that the residual amount of developing agent is small, and when the ratio is substantially equal to 0, the determining device determines the absence of developing agent.

12 Claims, 13 Drawing Sheets

DEVELOPING DEVICE HAVING A RESIDUAL TONER AMOUNT DISCRIMINATION FEATURE AND IMAGE FORMING APPARATUS USING SAME

BACKGROUND OF THE INVENTION

1. Field of the Invention

The invention relates to a developing device for developing an electrostatic latent image on an image holding member and an image forming apparatus having such a developing device. More particularly, the invention relates to an image forming apparatus suitable as a copying apparatus having a facsimile or printer function.

2. Related Background Art

Generally, in an image forming apparatus such as a copying apparatus, printer, or the like, micro fine powder called a toner is used as a developing agent, the toner is deposited onto a latent image formed on an image holding member, thereby visualizing a toner image, and the visualized image is fixed, thereby forming an image.

Therefore, since the toner is always consumed in association with the operation of the machine, a supply of the toner or an exchange of a development processing cartridge has to be promoted by a method such that a residual amount of toner is detected in a developing agent containing unit of a developing device and, when the absence of the toner is detected, such a fact is displayed or the like.

As a detecting means, for example, there is a method whereby, for example, a predetermined vibration is given to a sensor by a piezoelectric vibrator and the presence or absence of the toner is detected on the basis of a difference between the vibration when the toner exists on a sensor surface and the vibration when no toner exists, or the like.

FIG. 10 shows a conventional developing device in which such a sensor for detecting the presence or absence of the toner is arranged. In the developing device, a developing unit 2 for depositing a developing agent onto an image holding member and a developing agent containing unit 3 for containing the developing agent are integratedly formed and a sensor 7 to detect the presence or absence of the toner is arranged on the side surface of the developing agent containing unit 3. An agitator 11 serving as rotating means having an object for either one of or both of the agitation of the toner and the conveyance thereof is arranged in the developing agent containing unit 3. The toner in the developing agent containing unit 3 is moved by the agitator 11.

Therefore, even when a certain amount of developing agent exists in the developing agent containing unit 3, when the developing agent existing at the position of the sensor 7 for detecting the presence or absence of the toner is removed by the agitator 11, a signal indicative of the absence of the toner is temporarily generated. However, when the toner is reduced by a fairly large quantity, an output period of time of the signal indicative of the absence of the toner becomes long irrespective of the revolution of the agitator 11.

In such a case, even if a small amount of toner remains, the apparatus judges an "absence of toner" and stops the operation of the machine. The reason why the machine is stopped before the toner is completely eliminated in the developing agent containing unit 3 or developing unit 2 is because the toner has the roles of not only serving as a developing agent but also serving as a lubricating agent and if the machine is made operative in a no-toner state, namely, what is called an idling rotation state, for example, a coefficient of friction between a cleaning blade which is in contact with the image holding member and the image holding member extremely rises and there occurs an inconvenience such that the cleaning blade is peeled off or the cleaning blade scrapes the image holding member.

To avoid such an inconvenience, a level to detect the residual amount of toner in the developing agent containing unit 3 is set with a certain surplus. In a state in which a fairly large amount of toner remains by considering various safe conditions, the apparatus judges an "absence of toner" and stops the operation of the machine and a message of "absence of toner" is displayed, thereby promoting the user to promptly supply the toner.

According to the above conventional example, however, apart from a special operator, ordinary office users consider that the supply of the toner is an operation which is very troublesome. It is a general idea that if the user has to supply the toner in order to get only one sheet of copy, it is rather better to copy by looking for another copying apparatus. There is a case where the foregoing conventional control method of stopping the operation of the machine in spite of a fact that the toner of an amount enough to get one or two sheets of copies still remains actually obstructs an efficient operation of the machine.

SUMMARY OF THE INVENTION

It is an object of the invention to provide a developing device and an image forming apparatus in which even when the toner decreases, an image forming operation is performed for a predetermined period of time, thereby enabling a machine to be efficiently operated and a defective output image and damage of the machine don't occur.

Another object of the invention is to provide a developing device comprising: a developing unit for developing an electrostatic latent image on an image holding member; a developing agent containing unit for containing a developing agent which is supplied to the developing unit; agitating means, provided in the developing agent containing unit, for agitating the developing agent; a detecting sensor for detecting a residual amount of developing agent in the developing agent containing unit; and discriminating means for discriminating the residual amount of developing agent at a plurality of stages on the basis of an output state of the detecting sensor in a predetermined time range.

The above and other objects and features of the present invention will become apparent from the following detailed description and the appended claims with reference to the accompanying drawings.

DETAILED DESCRIPTION OF THE PREFERRED EMBODIMENTS

Figure 1:
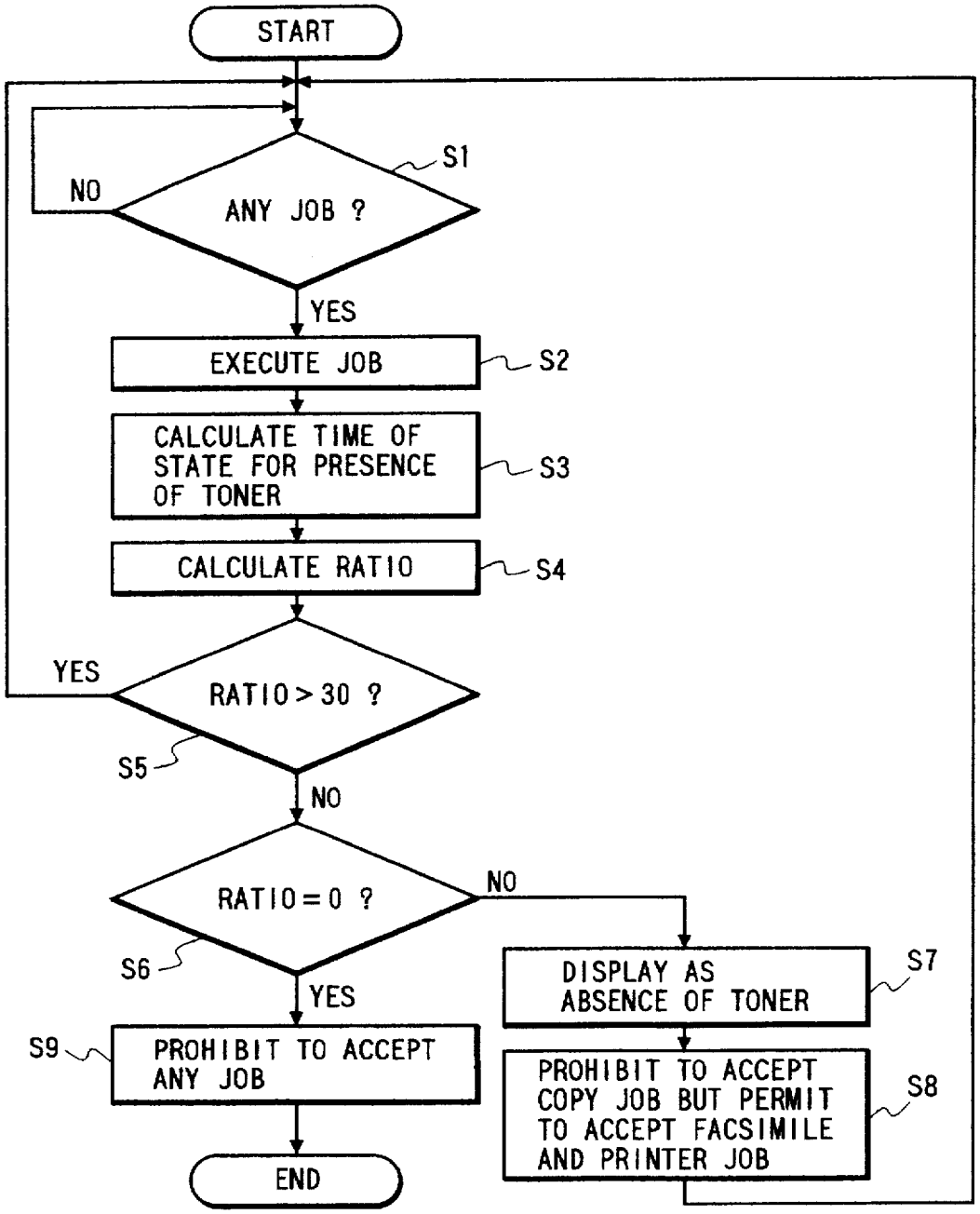
FIG. 1 is a flowchart for explaining a job management according to a detection output indicative of the presence or absence of a toner in the first embodiment of the invention.

Embodiments of the present invention will now be described hereinbelow with reference to the drawings.

[First embodiment]

The first embodiment of the invention will be first described with reference to FIGS. 1 to 8. FIG. 2 is a diagram showing an image forming apparatus in the first embodiment of the invention. Although the image forming apparatus according to the embodiment relates to a copying apparatus of the electrophotographic system, the apparatus can execute not only a normal copy job but also a facsimile and printer job on the basis of information from communication interface means.

In FIG. 2, reference numeral 1 denotes a developing device in which the developing unit 2 to deposit the toner as a developing agent onto a photosensitive drum 40 serving as an image holding member and the developing agent containing unit 3 to contain the toner as a developing agent are integratedly formed. Agitators 10 and 11 serving as rotating means and each having either one of or both of an agitation and a conveyance of the toner are arranged in the developing unit 2 and developing agent containing unit 3. The agitators convey the toner from the developing agent containing unit 3 to the developing unit 2 and agitate the toner so as to obtain an enough amount of charge.

On the other hand, in a state in which the surface of the photosensitive drum 40 as an image holding member is uniformly charged by a charging roller 48, a laser beam is irradiated from a laser scanner 47 onto the surface of the photosensitive drum 40, so that an electrostatic latent image is formed on the drum surface. By rotating the photosensitive drum 40 in the direction shown by an arrow, the electrostatic latent image is conveyed to a portion which faces the developing device 1.

The electrostatic latent image is developed and visualized by the developing device 1 by a developing method of a magnetic brushing system, a jumping system, or the like. The developed visual image is transferred onto a transfer sheet P transferred from a sheet feeding unit (not shown) by the operation of a transfer roller 41. Further, by applying a heat and a pressure to the transfer sheet P, the transferred image is fixed by a fixing unit 42, thereby forming an image. The untransferred toner remaining on the surface of the photosensitive drum 40 is scraped off by a cleaning blade 44 or the like in a cleaning unit 43 and is disposed as a drain toner. The surface of the photosensitive drum 40 is discharged by a discharging lamp 49 for preparation of the next image formation.

As mentioned above, since the toner is always consumed in association with the image forming operation, even in the embodiment, the sensor 7 for detecting the presence or absence of the toner serving as means for detecting the presence or absence of the developing agent is also provided in the developing agent containing unit 3 of the developing device 1, thereby promoting the supply of the toner. The developing device of the embodiment having such a toner presence/absence detecting sensor 7 will now be described in detail hereinbelow with reference to FIG. 3.

Figure 3:
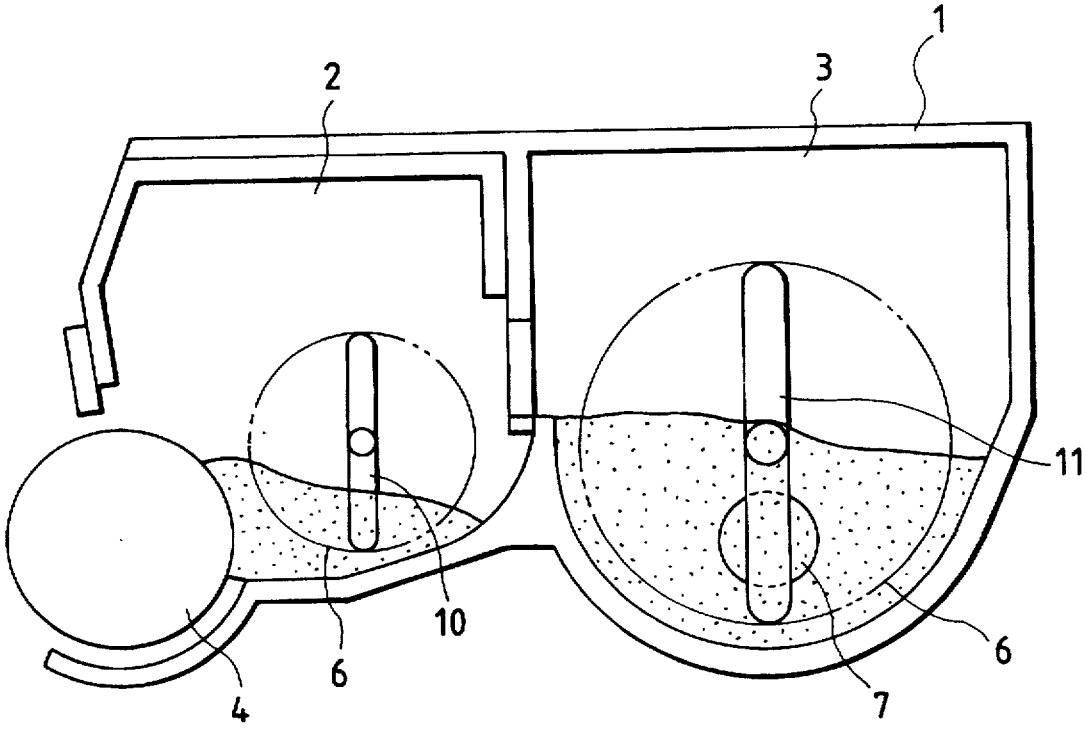
FIG. 3 is a diagram showing a schematic construction of a developing device in the first embodiment of the invention.

FIG. 3 is a diagram showing a schematic construction of the developing device of the first embodiment. As shown in FIG. 3, the developing device of the first embodiment is constructed in a manner such that the developing agent containing unit 3 and developing unit 2 are integratedly formed, a toner 6 is conveyed to the developing unit 2 by the agitator 11 arranged in the developing agent containing unit 3, and the toner 6 is further supplied to a developing sleeve 4 by the agitator 10 in the developing unit 2, thereby holding the toner on the developing sleeve 4 and performing the foregoing developing operation.

By separately providing the developing unit 2 and developing agent containing unit 3 as mentioned above, even when a new toner is supplied, the old toner and new toner are sufficiently agitated in the developing agent containing unit 3 and a predetermined charging amount is given to the mixed toner and, after that, the toner can be supplied to the developing unit 2, so that a good developing operation can be always preferably performed.

When the toner amount in the developing agent containing unit 3 decreases, the toner 6 cannot be supplied to the developing unit 2. In the developing device 1, therefore, the toner presence/absence detecting sensor 7 using a piezoelectric vibrator is arranged as developing agent presence/absence detecting means at a position near the bottom portion of the developing agent containing unit 3, thereby detecting the presence or absence of the toner.

A predetermined vibration is given to the sensor 7 by the piezoelectric vibrator. When the toner exists on the surface of the sensor and the vibration is suppressed, the sensor 7 generates a signal at the high (H) level. When no toner exists on the sensor surface and the vibration is not suppressed, the sensor 7 generates a signal at the low (L) level.

Therefore, although an output of the toner presence/absence detecting sensor 7 changes in dependence on a state of the toner on the sensor surface as a predetermined detecting region, namely, the revolution of the agitator 11, it shows characteristics as shown in FIGS. 4 to 7 depending on a residual amount of toner in the developing agent containing unit 3. Each of FIGS. 4 to 7 shows a motion of the toner according to a motion of the agitator 11 and the output signal of the toner presence/absence detecting sensor 7 corresponding to such a motion when the residual amount of toner in the developing agent containing unit 3 differs.

Figure 4:
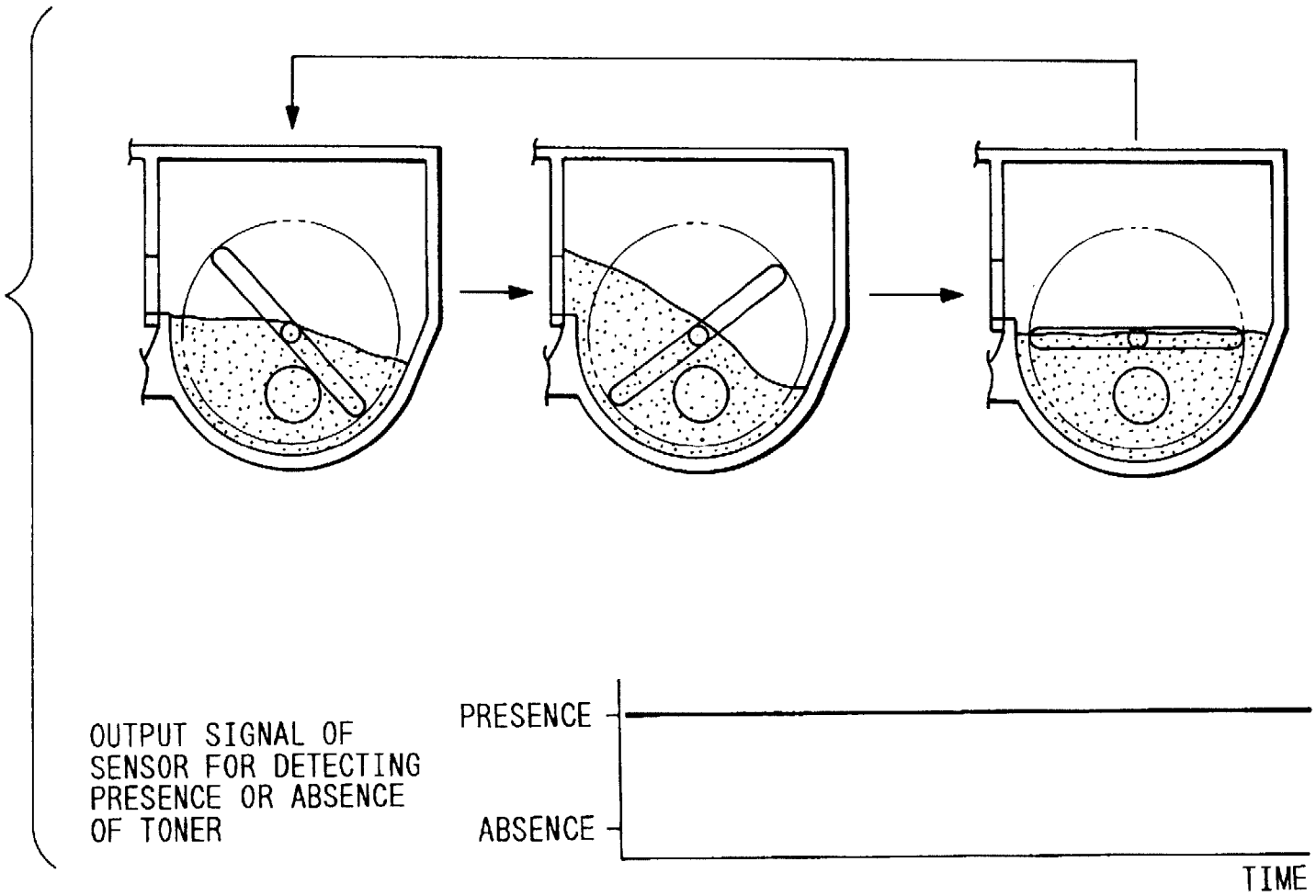
FIG. 4 is a diagram showing a motion of the toner by an agitator and an output signal of a sensor to detect the presence or absence of the toner when an enough quantity of toner exists in a developing agent containing unit in the first embodiment of the invention.

The state of FIG. 4 shows a case where the sufficient amount of toner 6 still remains in the developing agent containing unit 3 and even when the agitator 11 which is rotated to agitate and convey the toner 6 is positioned at any position, the toner presence/absence detecting sensor 7 doesn't generate a signal indicative of the absence of toner. The output at the H level is maintained.

Figure 5:
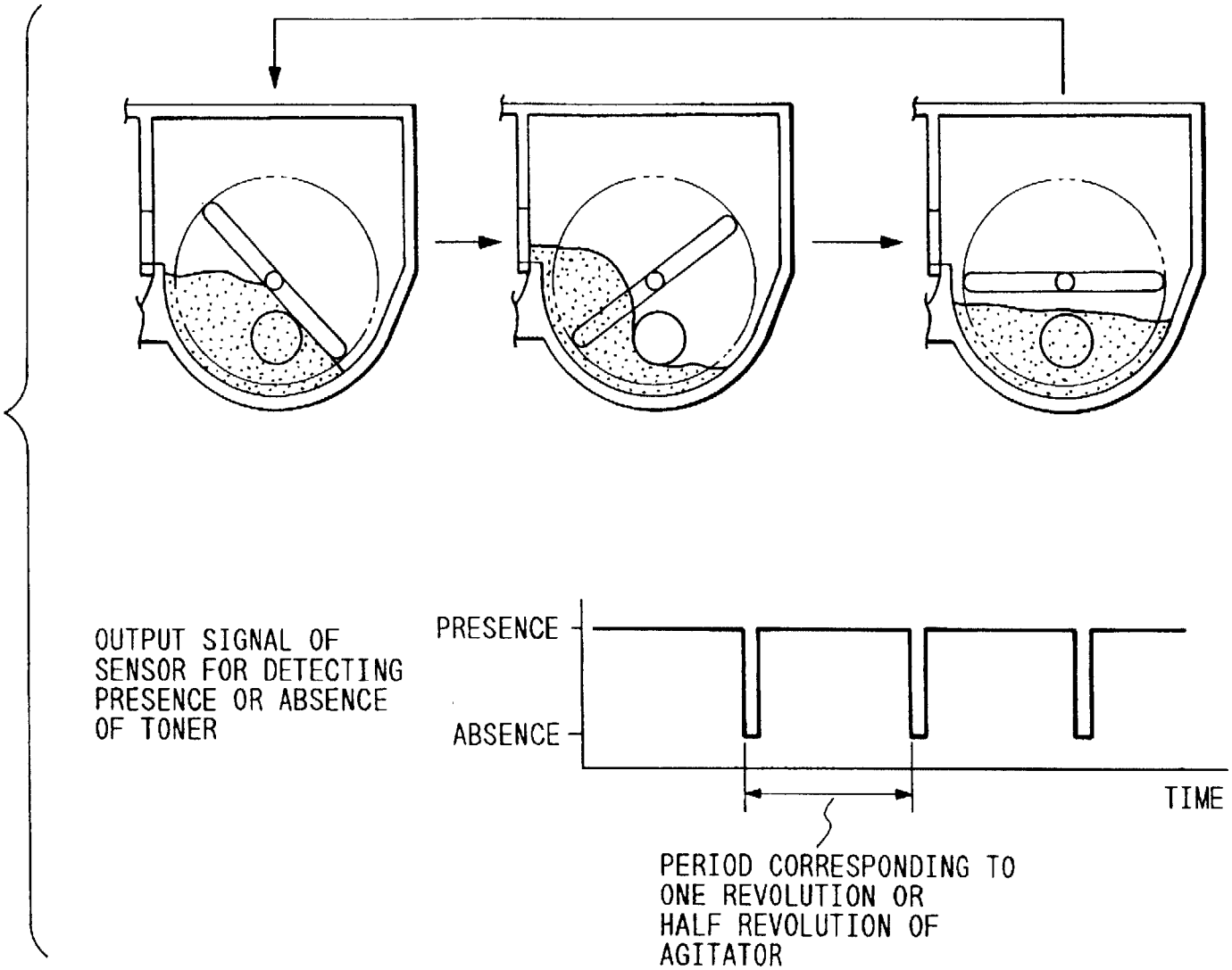
FIG. 5 is a diagram showing the motion of the toner by the agitator and the output signal of the sensor for detecting the presence or absence of the toner when the toner in the developing agent containing unit is reduced to an amount smaller than that in case of FIG. 4 in the first embodiment of the invention.

FIG. 5 shows a state in which the toner 6 has been consumed a little bit and just after the agitator 11 passed through the sensor 7, only for a short period of time during which the toner 6 is collected by the agitator 11, the surface of the sensor 7 is exposed from the toner 6 and the sensor 7 generates a signal at the L level indicative of the absence of toner. However, the sensor 7 generates a signal indicative of the presence of the toner in most of the period of time.

Figure 6:
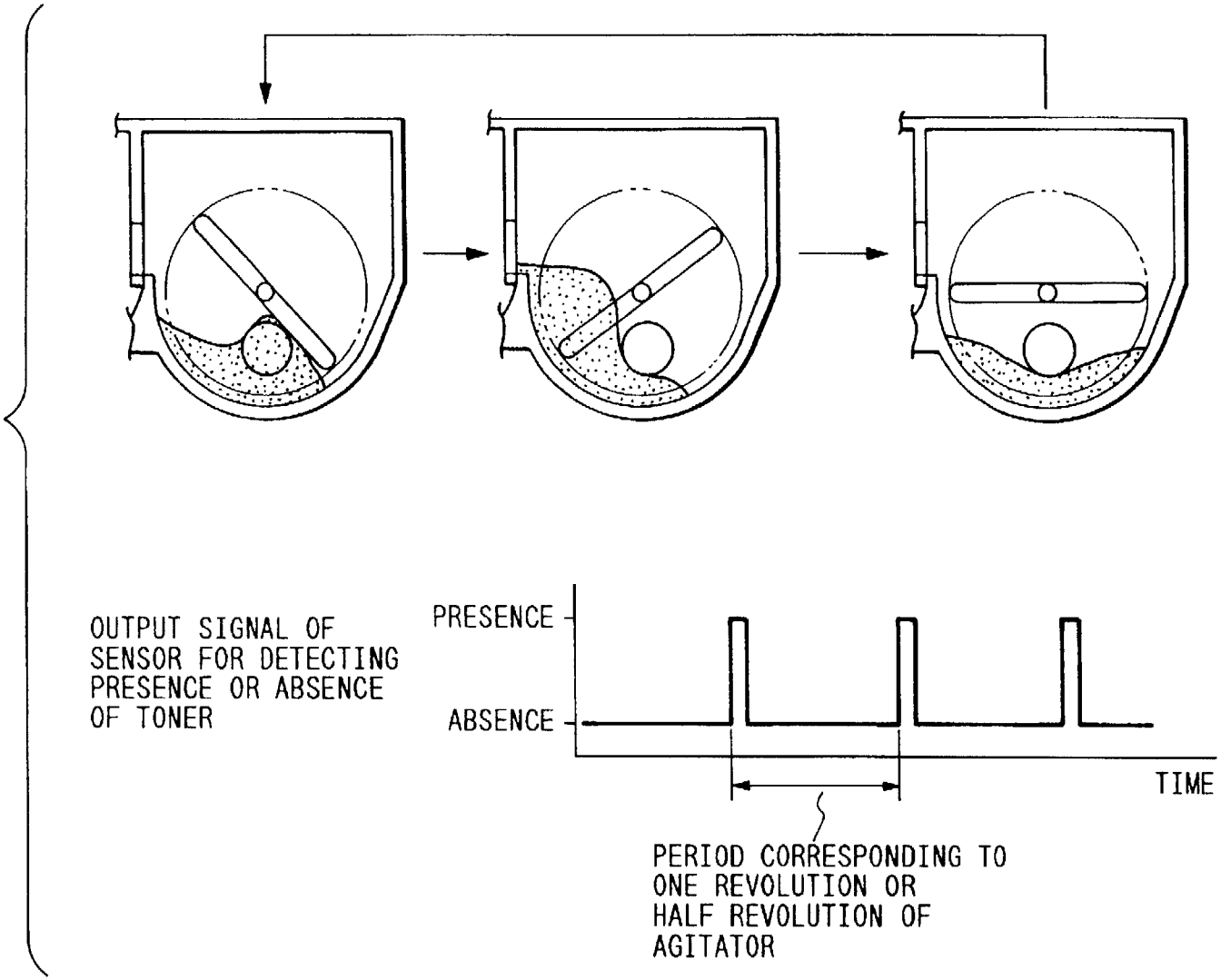
FIG. 6 is a diagram showing the motion of the toner by the agitator and the output signal of the sensor for detecting the presence or absence of the toner when the toner in the developing agent containing unit is reduced to an amount smaller than that in case of FIG. 5 in the first embodiment of the invention.

FIG. 6 shows a state in which the toner 6 has further been consumed. Only when the agitator 11 collects a small residual amount of toner 6 and comes to a position just before the sensor 7, the surface of the sensor 7 is come into contact with the toner 6 and the sensor 7 generates the signal indicative of the presence of toner.

Figure 7:
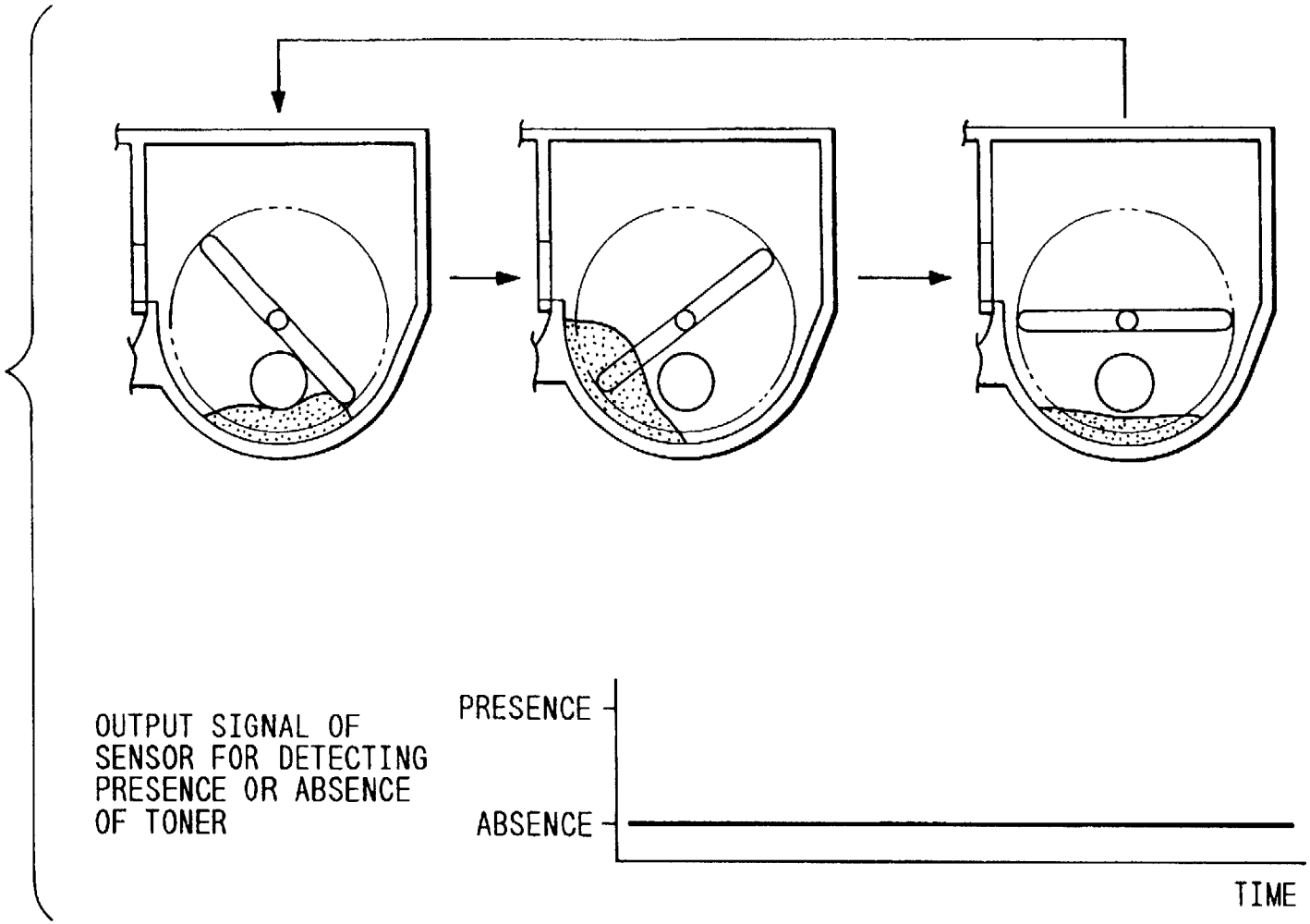
FIG. 7 is a diagram showing the motion of the toner by the agitator and the output signal of the sensor for detecting the presence or absence of the toner when the toner in the developing agent containing unit is reduced to an amount smaller than that in case of FIG. 6 in the first embodiment of the invention.

FIG. 7 shows a state in which the toner is further consumed and even when the agitator 11 rotates, the toner 6 does not come into contact with the surface of the sensor 7 and the sensor 7 always generates the signal indicative of the absence of toner.

Figure 8:
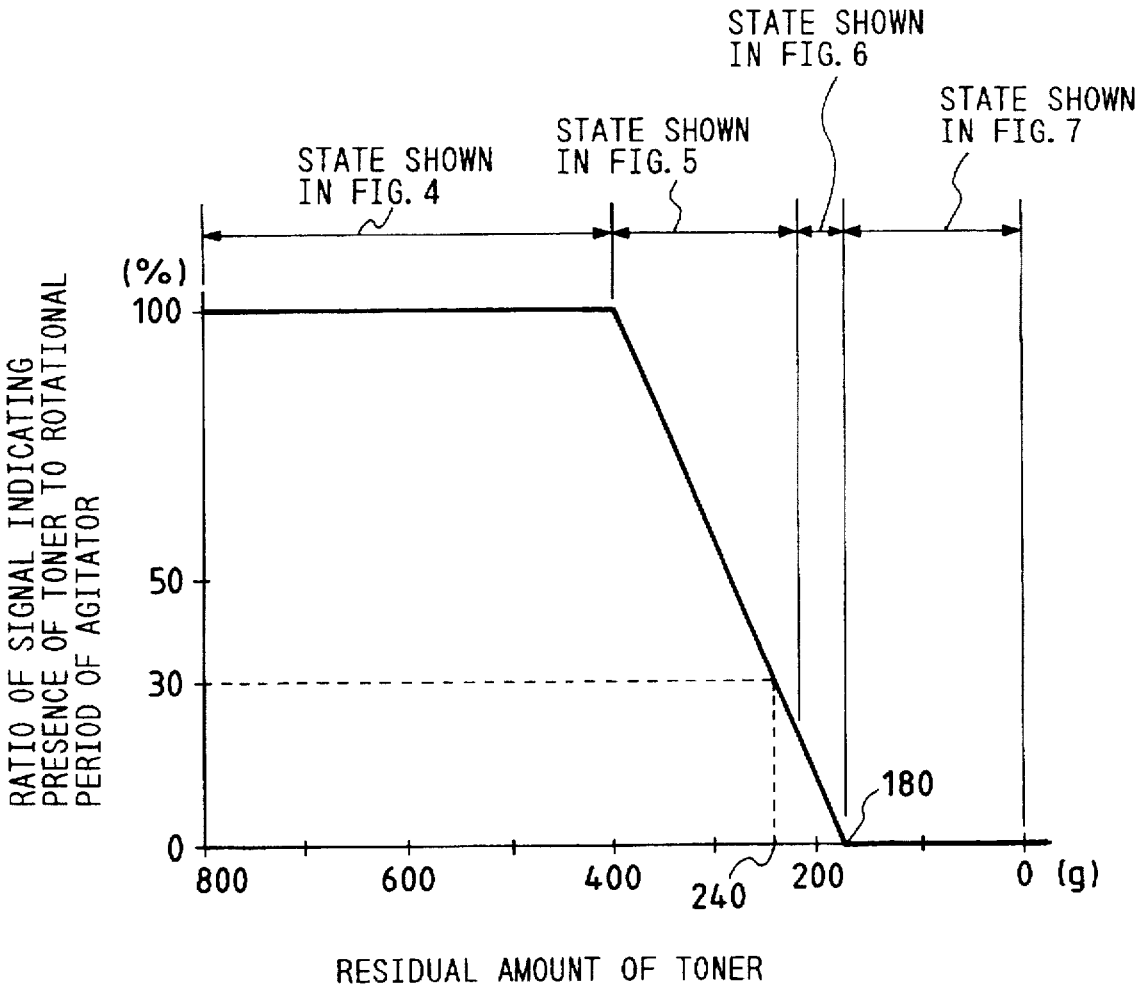
FIG. 8 is a diagram showing the relation between a ratio of an output of a signal indicative of the presence of toner by the sensor for detecting the presence or absence of the toner and the amount of residual toner in the first embodiment of the invention.

FIG. 8 is a graph quantitatively showing the relation between the residual amount of toner and an output state of the signal indicative of the presence of toner (signal at the H level) of the toner presence/absence detecting sensor 7 in association with the revolution of the agitator 11 described above. An axis of abscissa of the graph indicates the residual amount of toner and an axis of ordinate of the graph shows a ratio in which a rotational period of the agitator 11 in the developing agent containing unit 3 is set to a denominator and a time when the output signal of the toner presence/absence detecting sensor 7 indicates the presence of toner for the rotational period is set to a numerator.

The residual amount of toner when the ratio of the time when the output signal of the sensor 7 indicates the presence of toner is equal to 30% is set to 240 g. The residual amount of toner when the ratio is equal to 0% is set to 180 g.

Now, assuming that when the residual amount of toner in the developing agent containing unit 3 is set to 180 g, if the image forming operation is continuously executed without supplying the toner, what is called an idling rotation state in which no toner remains is caused. For example, there is a possibility in which an inconvenience such that a coefficient of friction between the cleaning blade 44 and photosensitive drum 40 extremely rises and the cleaning blade 44 is peeled off or the surface of the photosensitive drum 40 is scraped off by the cleaning blade 44 occurs. It is, therefore, necessary to stop the image forming operation.

When the residual amount of toner in the developing agent containing unit 3 is equal to 240 g, although it is preferable to supply the toner, the image formation can be permitted for a predetermined period of time, namely, until the residual amount of toner is reduced to 180 g.

In this embodiment, when the ratio obtained as mentioned above is equal to 30%, a message of "absence of toner" is displayed on display means (not shown), thereby promoting the supply of the toner. However, the image forming operation is not prohibited. When the ratio is set to 0%, the image forming operation is prohibited.

The time when the output signal of the toner presence/absence detecting sensor 7 indicates the presence of toner can be measured by a method such that a timer is started in response to a leading edge from the L level to the H level of the sensor 7 shown in FIG. 5 or the like. Each time the timer is interrupted at a predetermined sampling time, a count value of a memory is incremented by "1". When the output signal of the sensor 7 trails from the H level to the L level, the timer is stopped and the count value at that time is read. The time when the sensor output signal indicates the presence of toner can be obtained by processes such that after the count value was read, the count value is cleared and a similar measurement is again performed in response to the next leading edge, such a measurement is repeated a predetermined number of times, the measured values are stored, a mean value is obtained after completion of a job or the like.

As a rotational period of the agitator 11, a value which has previously been measured is used or a time interval from the trailing edge of the output signal of the sensor 7 to the next trailing edge is measured by using a timer in a manner similar to that mentioned above.

The time when the sensor output signal indicates the presence of toner obtained as mentioned above is divided by the rotational period of the agitator 11 which has previously been stored or which was measured as mentioned above, so that the ratio of the toner present state to the rotational period can be obtained.

A job management according to the toner presence/absence detection output in the embodiment will now be described hereinbelow with reference to the flowchart of FIG. 1.

Figure 2:
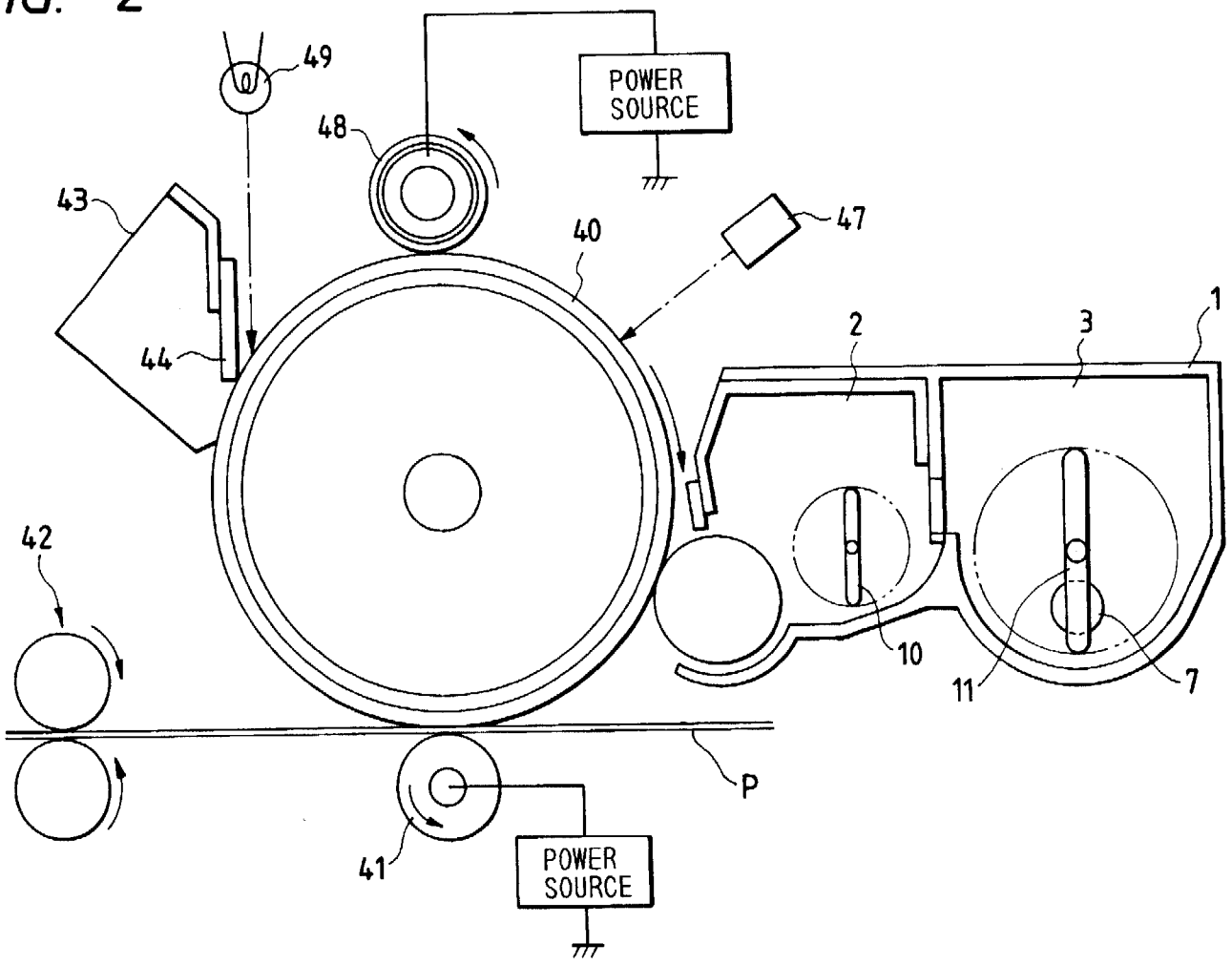
FIG. 2 is a diagram showing a schematic construction of an image forming apparatus in the first embodiment of the invention.

First in FIG. 1, when the apparatus is in a wait mode of a job (step S1), if there is a job request by a depression of a copy button, a copy job is executed (step S2). After completion of the job, the time indicative of the presence of toner is calculated as mentioned above (step S3). The ratio of the toner presence time to the rotational period is obtained (step S4). When it is judged that the ratio is larger than 30%, the processing routine is again returned to the wait mode of a job (step S5 to step S1).

When it is judged that the ratio is equal to or less than 30% (step S5), a check is made to see if the ratio is equal to 0% (step S6). If NO, since this means that the residual amount of toner lies within a range from 240 g or less to 180 g or more, a message of "absence of toner" is displayed (step S7). A message to promote the supply of the toner is displayed and, at the same time, the acceptance of a job such as a copy job such that the operator faces the apparatus and performs an operation is prohibited and the acceptance of a job such as a facsimile or printer job in which the supply of the toner is impossible because the operator is located at a remote position of the apparatus is permitted (step S8).

When there is a request of the facsimile or printer job through communication interface means after that, the facsimile or printer job is performed (steps S1 and S2). The ratio is calculated (steps S3 and S4). When the ratio is equal to 0% (step S6), all of the jobs are prohibited (step S9), thereby waiting for the supply of the toner.

According to the embodiment as mentioned above, the residual amount of toner at two levels can be detected by only a single toner presence/absence detecting sensor. A maximum image output can be obtained while assuring safety of the apparatus.

Since there is a difference of the maximum copy quantity, capacity of the developing agent containing unit, or the like depending on the kind of machine, the minimum desired toner amount in the developing unit differs. In such a case, therefore, the residual amount of toner can be also controlled by changing the position of the toner presence/absence detecting sensor from the rear side to the front side, changing such a position from the upper side to the lower side or the like, or changing a shape or the like of the agitator 11 on the side of the sensor 7.

The foregoing method of measuring the time indicative of the presence of toner and the method of calculating the ratio have been shown as an example and the invention is not limited to them.

[Second embodiment]

The second embodiment of the invention will now be described with reference to FIG. 9. Portions common to those in the first embodiment are designated by the same reference numerals and their descriptions are omitted here.

Figure 9:
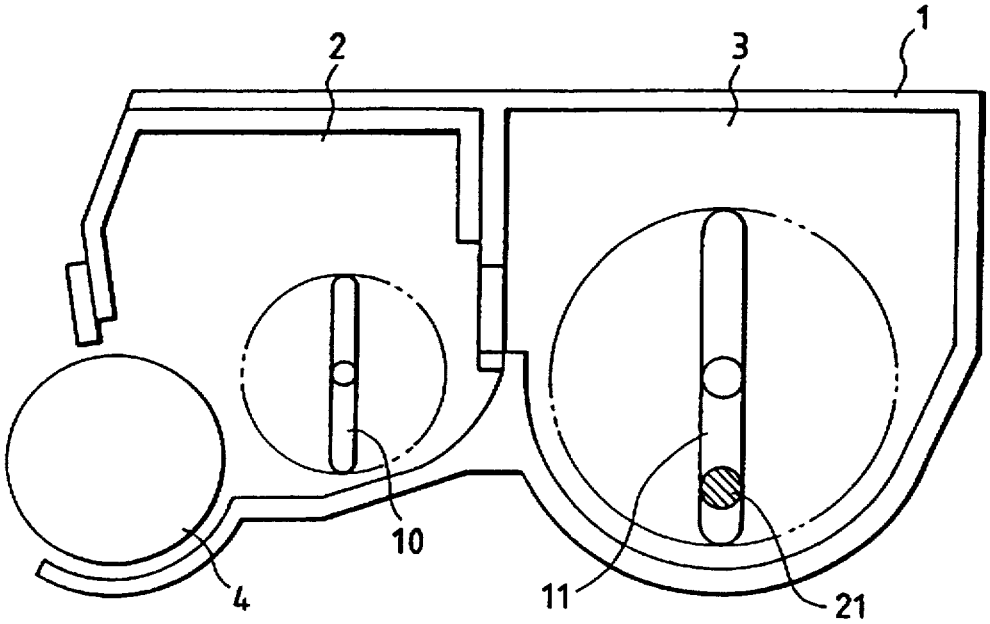
FIG. 9 is a schematic constructional diagram of a developing device in the second embodiment of the invention.
Figure 10:
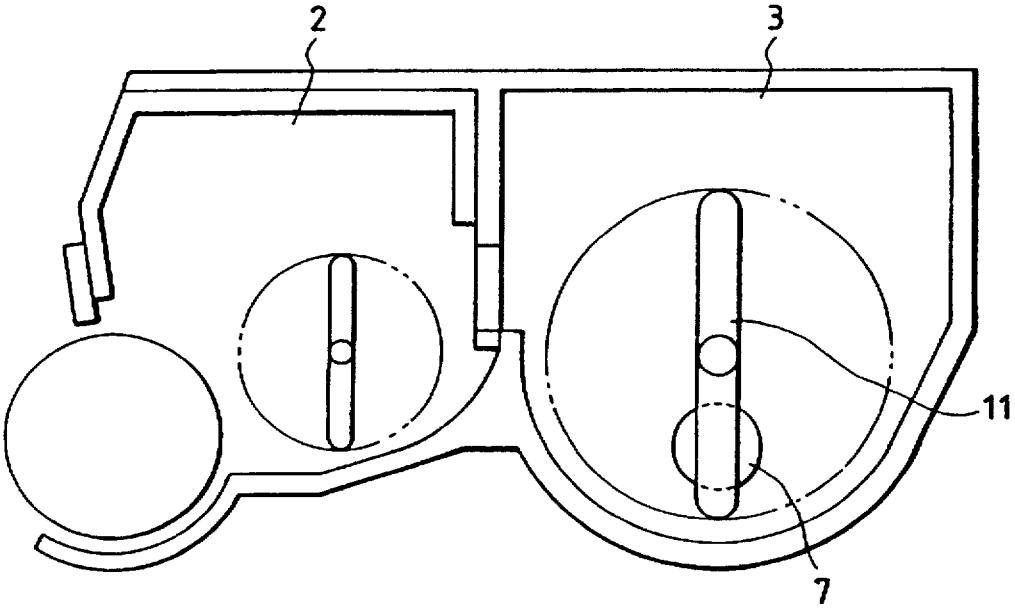
FIG. 10 PRIOR ART
FIG. 10 is a diagram showing a schematic construction of a conventional developing device.

FIG. 9 is a schematic constructional diagram showing a developing device in the second embodiment of the invention. The second embodiment is substantially similar to the first embodiment but differs therefrom with respect to a point that a sensor 21 for detecting the presence or absence of the toner is arranged as developing agent presence/absence detecting means onto the agitator 11.

In this case, an output from the toner presence/absence detecting sensor 21 is almost similar to that in the first embodiment although it is slightly different from that described in the first embodiment. A control at that time can be also similarly performed.

[Third embodiment]

The third embodiment of the invention will now be described. Explanation of portions common to those in the first embodiment is omitted here.

According to the invention, the ratio of the time when the output signal of the toner presence/absence detecting sensor indicates the presence of toner can be also displayed as a residual amount of toner. An outline of an image forming apparatus in the third embodiment has a construction similar to that in the first embodiment.

In the third embodiment, now assuming that the ratio of the time when the output signal of the toner presence/absence detecting sensor indicates the presence of toner is equal to R %, a ratio W % of the residual amount of toner is calculated by the following equation from a time point when R is equal to or less than 30%. The value of W % is displayed.

$$W\,\% = \{0.1-(1-R/30)\times 0.1\}\times 100$$

In this equation, when a toner supply amount of one time assumes 600 g, a residual toner amount ratio to the supply amount is shown by W % and when the residual amount of toner is equal to 180 g, the residual toner amount ratio is set to 0%.

According to the third embodiment, new effects such that the operator can know the residual amount of toner by multi-levels and can decide a timing to purchase the toner for next supply and the like can be obtained.

Although each of the above embodiments has been described with respect to an example in which all of the judgment about the detection of the presence or absence of the toner and the job management are performed by the control means such as a CPU or the like of the image forming apparatus main body, the invention is not limited to such an example. It is also possible to construct in a manner such that the detection of the presence or absence of the toner is judged by control means such as a CPU or the like provided for the developing device and a toner supply request, a stop request of the developing operation, and the like are further outputted from the control means of the developing device to the control means of the image forming apparatus main body in accordance with a state of the presence or absence of the toner.

Although each of the above embodiments has been described with respect to the example in which the piezoelectric vibrator is used as toner presence/absence detecting means, the invention is not limited to such an example but another toner presence/absence detecting means using well-known optical means or the like can be also used.

In the foregoing embodiments, the residual amount of toner is detected at a plurality of levels and the permission or inhibition of the image formation is controlled in accordance with an image forming mode.

However, there is a case where the following problems occur just after the toner was supplied in a state in which the residual amount of toner is very small.

Namely, the operator who is in a position to transmit an image signal from a remote location to the image forming apparatus and who has set the facsimile mode or printer mode cannot supply the toner to the developing device. Therefore, when the image forming operation in the facsimile mode or the like continues even after the residual toner amount detecting means detected that the residual amount of toner in the developing device had been decreased to a predetermined amount, there is a case where the toner amount in the developing device is fairly smaller than the predetermined amount. As mentioned above, when the apparatus enters a state in which the residual amount of toner in the developing device is very small, even if the toner is supplied after that, the supplied toner doesn't soon reach the developing portion and the toner is temporarily extinguished, so that a white-on-black portion occurs in an image.

An embodiment to solve such a problem will now be described.

[Fourth embodiment]

Figure 11:
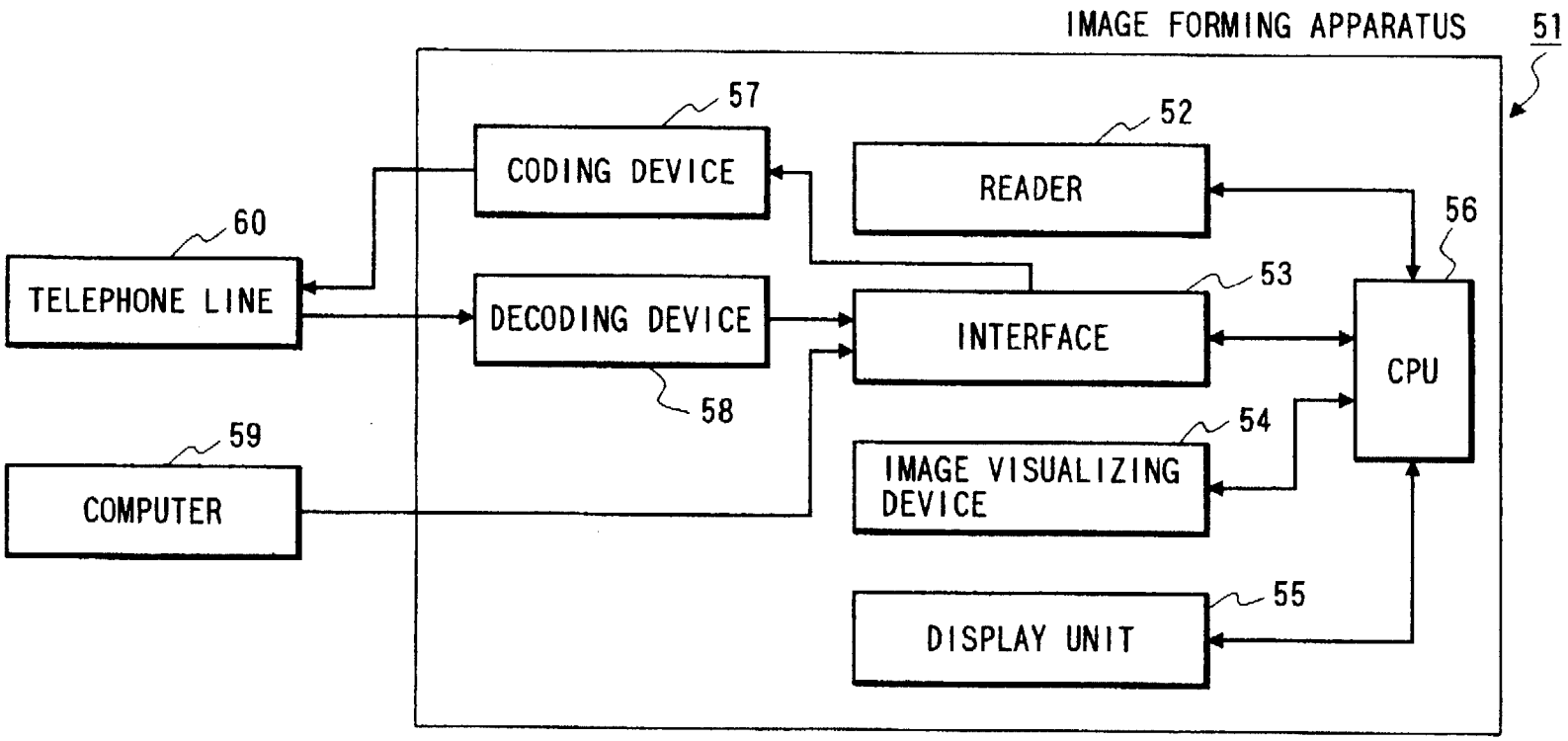
FIG. 11 is a block diagram showing a construction of an image forming apparatus according to the invention.

FIG. 11 is a block diagram showing a construction of an image forming apparatus 51 according to the invention. The image forming apparatus 51 commonly has functions of a facsimile apparatus, a printer, and a copying apparatus.

When the image forming operation is set into the facsimile mode in the image forming apparatus 51, an image signal from the facsimile apparatus which is transmitted via a telephone line 60 is decoded into a bit map like image signal by a decoding device 58 and, after that, the decoded signal is inputted to an image visualizing device 54 via an interface 53 and is developed and visualized by the image visualizing device 54. When the image forming operation is set to the printer mode, the image signal from a computer 59 is inputted to the image visualizing device 54 through the interface 53 and is visualized by the image visualizing device 54. Further, when the image forming operation is set into the copy mode, the image signal from a reader 52 is inputted to the image visualizing device 54 through the interface 53 and is developed and visualized by the image visualizing device 54.

Each of the reader 52, interface 53, image visualizing device 54, and a display unit 55 is controlled by mutually communicating with a CPU 56. In FIG. 11, reference numeral 57 denotes a coding device.

Figure 12:
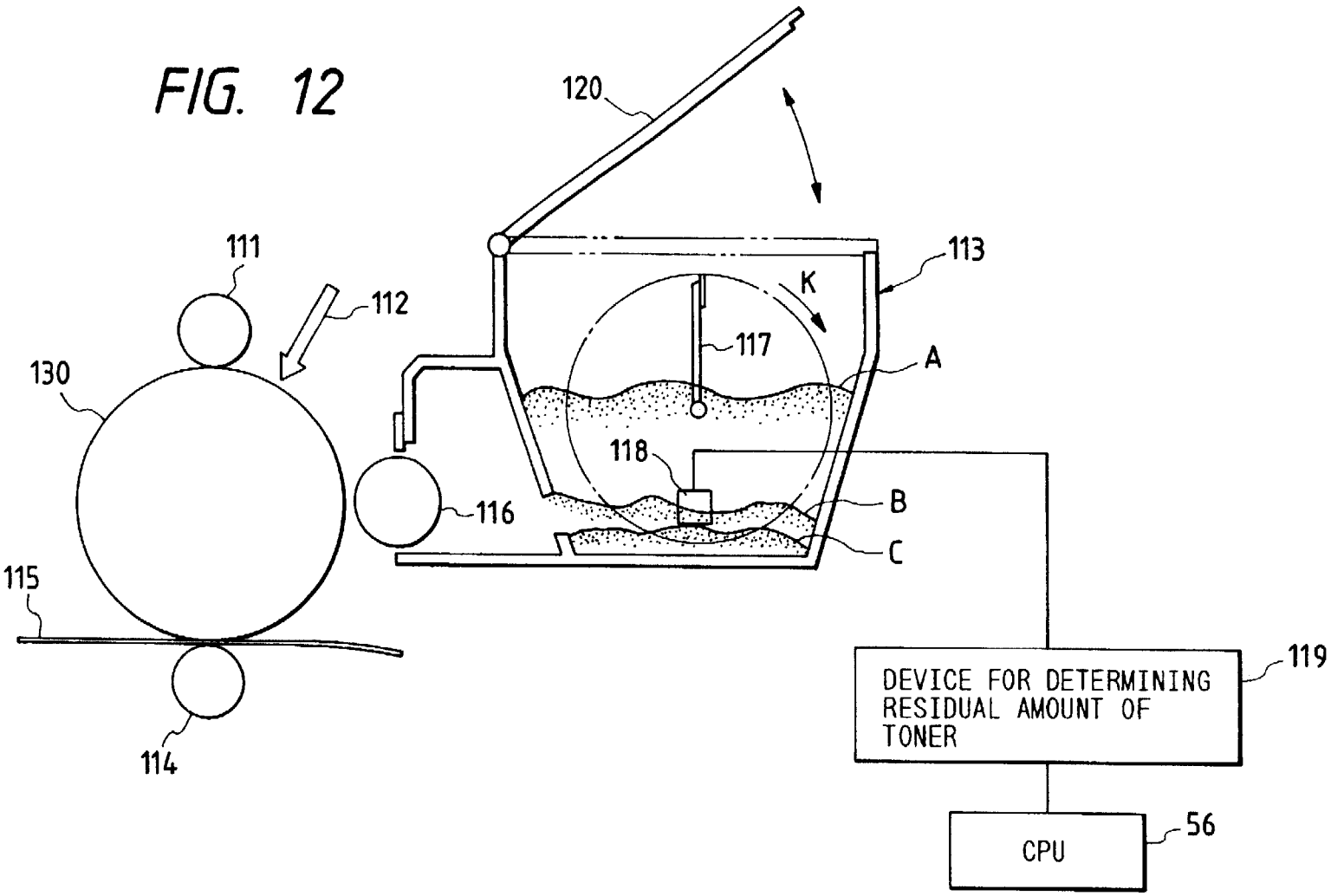
FIG. 12 is a vertical sectional view showing a construction of a main section of an image visualizing device of the image forming apparatus according to the invention.

The image visualizing device 54 will now be described with reference to FIG. 12. FIG. 12 is a vertical sectional view showing a construction of a main section of the image visualizing device 54.

In the image visualizing device 54, by scanning a laser beam 112 which is light emitted in correspondence to an inputted image signal onto the surface of an image holding member 130 which was uniformly charged by a primary charging device 111, an electrostatic latent image is formed on the surface of the image holding member 130. The electrostatic latent image is developed and visualized as a toner image by a developing device 113. The toner image is transferred to a transfer member 115 by a transfer device 114. The transfer member 115 to which the toner image was transferred is sent to a fixing device (not shown). The toner image is fixed to the transfer member 115 in the fixing device. The transfer member 115 to which the toner image was fixed is ejected to the outside of the apparatus.

In this embodiment, a uniform charged potential of the surface of the image holding member 130 is equal to −700 V, a latent potential corresponding to a white portion of an image is equal to −700 V, and a latent image potential corresponding to a black portion of the image is equal to −250 V. The developing device 113 allows a developing agent holding member 116 to which a developing bias voltage including a DC component was applied to face the image holding member 130, thereby developing an electrostatic latent image on the surface of the image holding member 130 and visualizing as a toner image. As a developing system, an inversion developing system using the toner of a minus polarity is used.

Means 118 for detecting the presence or absence of the toner to detect a residual amount of toner and an agitating member 117 which rotates in the direction of an arrow K shown in the diagram in an interlocking manner with the rotation of the image holding member 130 are arranged in the developing device 113. The toner presence/absence detecting means 118 is constructed by a piezoelectric element, detects the presence or absence of the toner in a portion just before the toner presence/absence detecting means 118 in the developing device 113, and supplies a detection signal to a device 119 for determining a residual amount of toner.

The residual toner amount determining device 119 determines the residual amount of toner by a determining method as will be explained hereinbelow at three levels and supplies a result to the CPU 56.

Namely, when the toner remains in the developing device 113 up to a level shown at A in FIG. 12, even if the agitating member 117 revolves, the toner presence/absence detecting means 118 always generates a signal indicative of the presence of toner. In this case, the residual amount of toner is enough and a fact that the residual amount is at the first residual level at which it is regarded that there is no need to supply the toner is informed to the CPU 56.

When the toner remains in the developing device 113 up to a level shown at B in FIG. 12, an output signal indicative of the presence of toner and an output signal indicative of the absence of toner are alternately repetitively generated from the toner presence/absence detecting means 118 synchronously with the revolution of the agitating member 117. In such a case, a fact that the residual amount of toner is at the second residual level at which it is necessary to perform the next toner supply is informed to the CPU 56.

Further, when the toner remains in the developing device 113 up to a level shown at C in FIG. 3, even if the agitating member 117 revolves, the toner presence/absence detecting means 118 always generates the signal indicative of the absence of toner. In this case, a fact that the residual amount of toner is at the third residual level at which even one image forming operation cannot be permitted so long as the next toner supply is not performed is informed to the CPU 56.

When the toner is supplied into the developing device 113, a cover 120 to supply the toner as a part of the developing device 113 is opened as shown in the diagram and the toner is supplied from the upper portion of the opened developing device 113 into the developing device 113 by using a toner container (not shown). As means for detecting whether the toner has been supplied or not, toner supply detecting means (not shown) for detecting the opening or closure of the cover 120 is provided for the cover 120 for supplying the toner. Each time the toner supply cover 120 is opened or closed, the toner supply detecting means supplies a detection signal to the CPU 56.

The CPU 56 controls the image visualizing device 54, display unit 55, and the like on the basis of information from the residual toner amount determining device 119.

Namely, when the signal which is sent from the residual toner amount determining device 119 to the CPU 56 is at the first residual level, even if the image signal is received from any one of the telephone line 60, computer 59, and reader 52, the image formation is immediately executed.

When the signal which is sent from the residual toner amount determining device 119 to the CPU 56 is at the second residual level, a toner supply indication lamp (not shown) of the display unit 55 is lit on. When the received image signal is the image signal from the telephone line 60 or computer 59, the image formation is executed. When the received image signal is the image signal from the reader 52, the image formation is not executed but a message informing that the image formation in the copy mode is prohibited because of a lack of residual amount of toner is displayed by the display unit 55.

Further, when the signal which is sent from the residual toner amount determining device 119 to the CPU 56 is at the third residual level, the toner supply indication lamp (not shown) of the display unit 55 is lit on. Even if the received image signal is the image signal from any one of the telephone line 60, computer 59, and reader 52, the image formation is not executed. A message informing that all of the image forming operations are prohibited because of a complete lack of residual amount of toner is displayed by the display unit 55.

Figure 13:
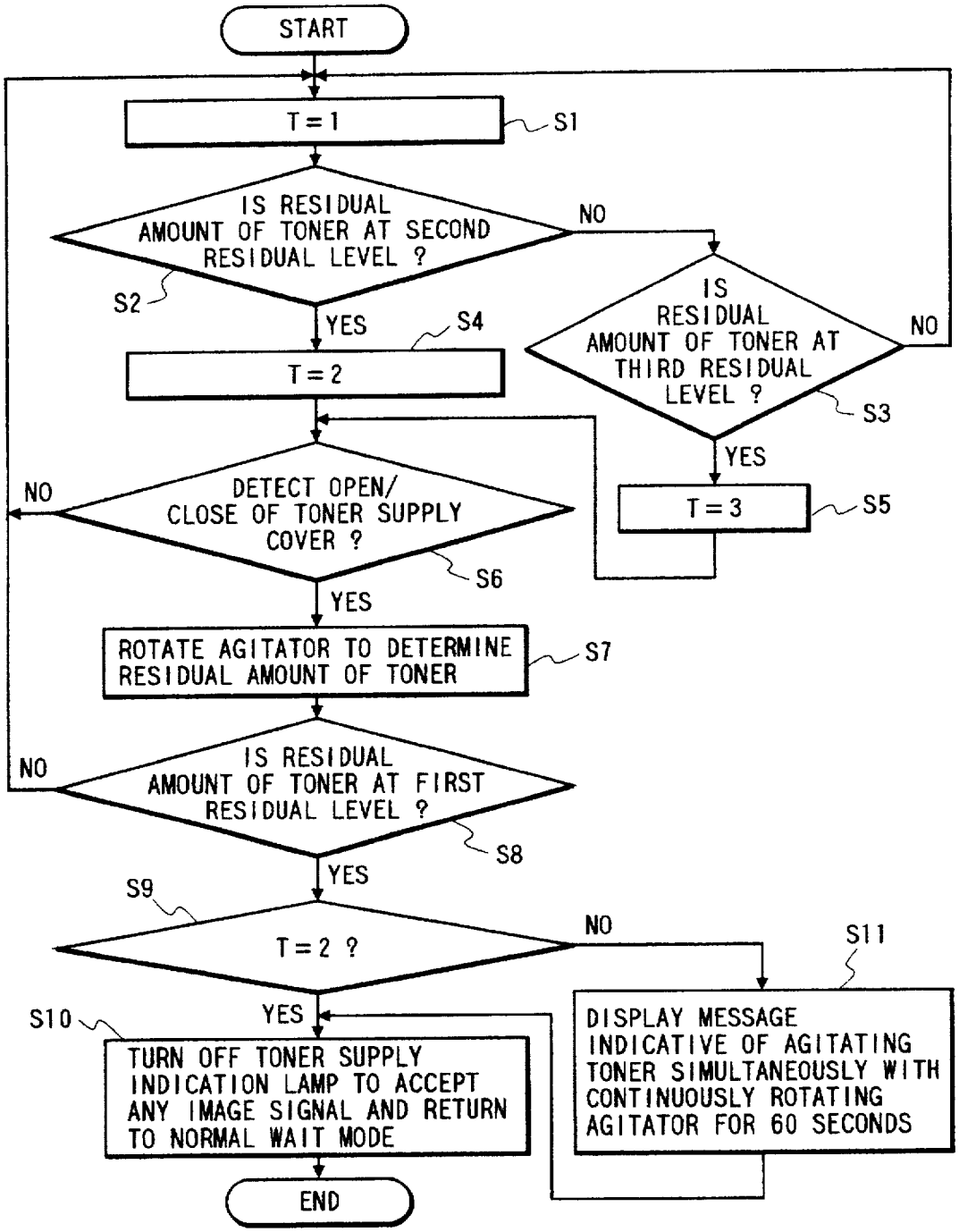
FIG. 13 is a flowchart showing the operation after the toner was supplied in the image forming apparatus according to the invention.

The operation after the toner was supplied in the image forming apparatus 51 will now be described with reference to a flowchart shown in FIG. 13.

When the image forming operation is started, a flag T is set to 1 (T=1) (step S1) and the level of the residual amount of toner is judged by the toner presence/absence detecting means 118 and residual toner amount determining device 119. That is, whether the residual amount of toner is at the second residual level or not is judged (step S2). If YES, the flag T is set to 2 (T=2) (step S4). When it is not at the second residual level, a check is made to see if the residual amount of toner is at the third residual level (step S3). If YES, the flag T is set to 3 (T=3) (step S5). When it is not at the third residual level (namely, when it is at the first residual level), the above operations are repeated. Therefore, when the residual amount of toner is at the first residual level, the flag is set to T=1 (step S1). When it is at the second residual level, T=2 (step S4). When it is at the third residual level, T=3 (step S5).

When the residual amount of toner is at the second or third residual level (namely, when the flag T is set to T=2 or T=3), after completion of the image forming operation, a check is made to see if the toner supply detecting means has detected the opening or closure of the toner supply cover 120 (step S6). When the opening or closure of the cover 120 is detected, while revolving the agitating member 117 for ten seconds irrespective of the image forming operation, the residual amount of toner is again judged by the toner presence/absence detecting means 118 and residual toner amount determining device 119 (step S7). The CPU 56 confirms that the residual amount of toner has been recovered to the first residual level (step S8). Namely, the CPU confirms that the toner has certainly been supplied after the cover 120 was opened and closed. By confirming it, an erroneous operation such that after the toner supply cover 120 was opened and closed without accompanying the actual toner supply, the image forming apparatus 51 is returned to a normal state in which there is no need to supply the toner can be prevented. When the opening or closure of the cover 120 is not detected, the above operations (operations in steps S1 to S5) so far are repeated.

When the CPU 56 confirms that the residual amount of toner has been recovered to the first residual level, a check is made to see if the residual amount of toner is at the second residual level at a time point when the toner is supplied (whether the present flag T has been set to 2 or not) (step S9). When the residual amount of toner is at the second residual level (T=2), the toner supply indication lamp of the display unit 55 is turned off. Any image signal in the copy mode, facsimile mode, or printer mode is accepted, thereby returning into the normal wait mode to execute the image forming operation (step S10).

When the residual amount of toner is at the third residual level (T=3), the agitating member 117 is continuously rotated for 60 seconds and, at the same time, a message informing that the toner is being agitated is displayed by the display unit 55 (step S11). After that, the toner supply indication lamp of the display unit 55 is lit off and any image signal of the copy mode, facsimile mode, or printer mode is accepted and the apparatus is returned to the normal wait mode for executing the image forming operation (step S10).

According to this embodiment, even when the toner consumption progresses to the third residual level, the toner in the developing device 113 after completion of the toner supply is sufficiently agitated and conveyed by the agitating member 117, so that the supplied toner can be fed to a position near the developing agent holding member 116. Consequently, the enough toner is supplied to a developing portion and, accordingly, a good image without a white-on-black portion or the like can be always stably formed.

[Fifth embodiment]

Figure 14:
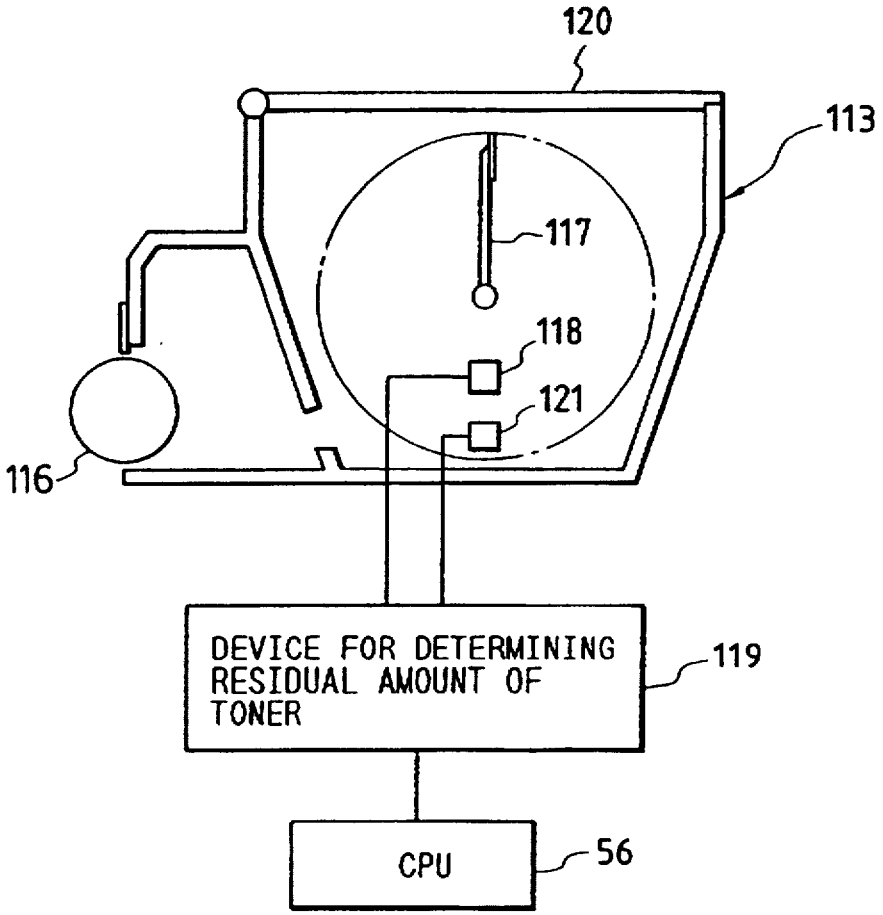
FIG. 14 is a vertical sectional view of a developing device of an image forming apparatus according to the fifth embodiment of the invention.

The fifth embodiment of the invention will now be described with reference to FIG. 14. FIG. 14 is a vertical sectional view of a developing device of an image forming apparatus according to the fourth embodiment of the invention. In the diagram, the same component elements as those shown in FIG. 12 are designated by the same reference numerals.

In this embodiment, a method whereby by providing two toner presence/absence detecting means 118 and 121 in the developing device 113, the residual amount of toner in the developing device 113 is detected at a plurality of levels is used. Namely, two first and second toner presence/absence detecting means 118 and 121 of different attaching heights are arranged in the developing device 113 and the residual toner amount determining device 119 determines the residual amount of toner on the basis of outputs of the two toner presence/absence detecting means 118 and 121.

When both of the first and second toner presence/absence detecting means 118 and 121 generate signals indicative of the presence of toner, the residual toner amount determining device 119 determines that the residual amount of toner is at the first residual level. When only the first toner presence/absence detecting means 118 attached in the upper position generates a signal indicative of the absence of toner, the device 119 decides that the residual amount of toner is at the second residual level. When both of the first and second toner presence/absence detecting means 118 and 121 generate the signal indicative of the absence of toner, the device 119 decides that the residual amount of toner is at the third residual level. The operation of the image forming apparatus after the determination of the residual amount of toner is similar to that in the fourth embodiment (refer to the flowchart shown in FIG. 13).

[Sixth embodiment]

The sixth embodiment of the invention will now be described.

According to this embodiment, the residual amount of toner is detected at a plurality of levels by only one toner presence/absence detecting means 118 in a manner similar to the fourth embodiment. The number of image forming operations executed after the residual amount of toner was changed from the first residual level to the second residual level is counted by the CPU 56 and a toner agitating time by the agitating member 117 in the developing device 113 after completion of the toner supply is switched in accordance with a value of the count number of times. For example, when the count number is equal to or less than 500, the recovery after the toner supply is performed by the same operation as the recovery from the second residual level in the first embodiment. When the count number exceeds 500, the toner in the developing device 113 is sufficiently agitated and conveyed by the same operation as the recovery from the third residual level in the fourth embodiment and, after that, the recovery after completion of the toner supply is executed.

[Seventh embodiment]

The seventh embodiment of the invention will now be described.

An image forming apparatus according to the embodiment is of a type such that the developing device is taken out from the image forming apparatus main body and the toner is supplied into the developing device. Detecting means for detecting a detachment of the developing device is provided and the execution of the toner supply is detected by an output of the detecting means.

[Eighth embodiment]

The eighth embodiment of the invention will now be described.

This embodiment shows another form of changing the operation of the agitating means.

Namely, in this embodiment, when the toner is supplied at the second residual level, the apparatus is recovered to the normal mode by the same operation as that in the first embodiment. A method whereby when the toner is supplied at the third residual level, the acceptance mode for the image signal is recovered to the normal mode and in the image forming operations of 50 times which are executed after that, the rotation time of the agitating member is extended every two seconds, thereby sufficiently executing the agitation and conveyance of the toner is used.

According to this embodiment, there is an advantage such that the image forming operation just after the toner supply can be soon executed.

Although the preferred embodiments of the present invention have been described above, the invention is not limited to the foregoing embodiments but many modifications and variations are possible within the spirit and scope of the appended claims of the invention.

What is claimed is:

1. A developing device comprising:

a developing unit for developing an electrostatic latent image on an image bearing member;

a developing agent containing unit for containing a developing agent which is to be supplied to said developing unit;

agitating means, provided in said developing agent containing unit, for agitating the developing agent;

a detecting sensor for detecting a residual amount of developing agent in said developing agent containing unit; and discriminating means for discriminating the residual amount of developing agent in a predetermined time range on the basis of an output state of said detecting sensor, said discriminating means discriminating both of a first level at which said developing agent is sufficient for ordinary use of said developing device and a plurality of other levels at which said developing agent is insufficient for ordinary use of said developing device.

2. A device according to claim 1, wherein said determining means determines the residual amount of developing agent on the basis of a ratio of an output time of a developing agent presence state of said detecting sensor and an output time of a developing agent absence state in said predetermined time range.

3. A device according to claim 2, wherein when a ratio at which the output time of the developing agent presence state of said detecting sensor occupies in said predetermined time range is equal to or less than a predetermined value, said determining means determines that the residual amount of developing agent is small, and when said ratio is substantially equal to 0, said determining means determines the absence of developing agent.

4. A device according to claim 3, wherein said developing device is used in an image forming apparatus, and said image forming apparatus includes: display means for displaying the absence of developing agent when said determining means determines that the residual amount of developing agent is small; and prohibiting means for prohibiting an acceptance of an image forming job when said determining means determines the absence of developing agent.

5. A device according to claim 4, wherein said image forming apparatus has copy, facsimile, and printer functions, and when said determining means determines that the residual amount of developing agent is small, said prohibiting means prohibits only a copy job, and when said determining means determines the absence of developing agent, said prohibiting means prohibits an acceptance of all of image forming jobs.

6. A device according to claim 1, wherein said detecting sensor comprises a piezoelectric element.

7. A device according to claim 1, wherein said predetermined time corresponds to a rotational period of said agitating means.

8. An image forming apparatus comprising:

an image holding member for holding an electrostatic latent image;

developing means for developing the electrostatic latent image on said image holding member, said developing means having a conveying member for conveying a developing agent contained in said developing means toward a developing unit;

supply detecting means for detecting that the developing agent has been supplied to said developing means from the outside of the apparatus;

residual amount detecting means for detecting a residual amount of developing agent in said developing means at a plurality of levels; and control means for controlling the driving of said conveying member just after the supply of the developing agent in accordance with a residual level of the developing agent just before the developing agent is supplied to said developing means from the outside of said apparatus.

9. An apparatus according to claim 8, wherein said residual amount detecting means comprises a developing agent sensor and said residual amount detecting means detects the residual amount of developing agent on the basis of an output state of said sensor in a predetermined time range.

10. An apparatus according to claim 8, wherein said apparatus further comprises an opening/closing portion which is opened and closed to supply the developing agent, and said supply detecting means includes an open/close detecting member for detecting the open/close of said opening/closing portion.

11. An apparatus according to claim 8, wherein at least a part of said developing means is detachable and said supply detecting means includes an attachment/detachment detecting member for detecting an attachment/detachment of said developing means.

12. An apparatus according to claim 8, wherein as the residual amount of developing agent just before the developing agent is supplied is small, said control means extends a driving time of said conveying member just after the supply of the developing agent.

* * * * *

UNITED STATES PATENT AND TRADEMARK OFFICE

CERTIFICATE OF CORRECTION

PATENT NO. : 5,790,917

DATED : August 4, 1998

INVENTOR(S) : KEIZO TAKURA, ET AL.

It is certified that error appears in the above-identified patent and that said Letters Patent is hereby corrected as shown below:

COLUMN 2:

Line 32, "don't" should read --do not--.

COLUMN 5:

Line 26, "is come" should read --comes--.

COLUMN 11:

Line 42, "the" should be deleted.

COLUMN 12:

Line 3, "the" (first occurrence) should be deleted;
Line 9, "the" (first occurrence) should read --this--; and
Line 39, "the" should read --this--.

UNITED STATES PATENT AND TRADEMARK OFFICE

CERTIFICATE OF CORRECTION

PATENT NO. : 5,790,917

DATED : August 4, 1998

INVENTOR(S) : KEIZO TAKURA, ET AL.

It is certified that error appears in the above-identified patent and that said Letters Patent is hereby corrected as shown below:

COLUMN 13:

Line 19, "device" should read --device,--.

Signed and Sealed this

Twenty-fifth Day of May, 1999

*Attest:*

Q. TODD DICKINSON

*Attesting Officer*

*Acting Commissioner of Patents and Trademarks*